US008528692B2

(12) United States Patent
Teshima

(10) Patent No.: US 8,528,692 B2
(45) Date of Patent: Sep. 10, 2013

(54) AIR INTAKE DUCT

(75) Inventor: Koya Teshima, Aichi (JP)

(73) Assignee: INOAC Corporation, Aichi (JP)

( * ) Notice: Subject to any disclaimer, the term of this patent is extended or adjusted under 35 U.S.C. 154(b) by 0 days.

(21) Appl. No.: 13/519,092

(22) PCT Filed: Jun. 6, 2011

(86) PCT No.: PCT/JP2011/062924
§ 371 (c)(1),
(2), (4) Date: Jun. 25, 2012

(87) PCT Pub. No.: WO2011/155437
PCT Pub. Date: Dec. 15, 2011

(65) Prior Publication Data

US 2012/0292127 A1 Nov. 22, 2012

(30) Foreign Application Priority Data

Jun. 8, 2010 (JP) ..... 2010-131358

(51) Int. Cl.
*F02M 35/00* (2006.01)

(52) U.S. Cl.
USPC ..... 181/229; 123/184.53; 123/184.54; 123/184.56; 123/184.55; 123/184.57

(58) Field of Classification Search
USPC ..... 181/229; 123/184.54, 184.55, 184.56, 123/184.57, 184.61
See application file for complete search history.

(56) References Cited

U.S. PATENT DOCUMENTS

| | | | | |
|---|---|---|---|---|
| 6,959,678 | B2 * | 11/2005 | Kino et al. | 123/184.53 |
| 7,802,651 | B2 * | 9/2010 | Park et al. | 181/224 |
| 8,132,552 | B2 * | 3/2012 | Matsumoto et al. | 123/184.61 |
| 8,162,101 | B2 * | 4/2012 | Ono | 181/229 |
| 8,316,987 | B2 * | 11/2012 | Ishida et al. | 181/247 |
| 2004/0065288 | A1 | 4/2004 | Kino et al. | |
| 2004/0134460 | A1 | 7/2004 | Kino et al. | |
| 2004/0231912 | A1 * | 11/2004 | Fukumoto | 181/249 |
| 2005/0173186 | A1 | 8/2005 | Kino et al. | |
| 2008/0156579 | A1 * | 7/2008 | Hayashi | 181/229 |
| 2009/0293832 | A1 | 12/2009 | Matsumoto et al. | |

FOREIGN PATENT DOCUMENTS

| | | | |
|---|---|---|---|
| FR | 2914958 | A1 | 10/2008 |
| JP | 515568 | Y2 | 4/1993 |
| JP | 2000282985 | A | 10/2000 |

(Continued)

OTHER PUBLICATIONS

Search Report dated Jun. 28, 2011 issued in International Application No. PCT/JP2011/062924 (PCT/ISA/210).

(Continued)

*Primary Examiner* — Forrest M Phillips
(74) *Attorney, Agent, or Firm* — Sughrue Mion, PLLC

(57) ABSTRACT

To simplify the attachment of a cover member, an air intake duct 10 includes a duct body 12 having an air flow passage 14 communicating from an inlet port 12*a* to an outlet port 12*b* and a vent hole 28 communicating from the air flow passage 14 to the outside, an air permeable cover member 32, and a holding member 34 secured to extend along an outer inner circumferential surface or an inner circumferential surface of the duct body 12 and to hold a portion of the cover member 32 covering the vent hole at a location different from the vent hole 28. The holding member 34 is detachably attached to the duct body 12.

13 Claims, 16 Drawing Sheets

(56) References Cited

FOREIGN PATENT DOCUMENTS

| | | | |
|---|---|---|---|
| JP | 2003065173 | A | 3/2003 |
| JP | 2003328885 | A | 11/2003 |
| JP | 2008240694 | A | 10/2008 |
| JP | 2009293442 | A | 12/2009 |

OTHER PUBLICATIONS

Written Opinion dated Jun. 28, 2011 issued in International Application No. PCT/JP2011/062924 (PCT/ISA/237).

* cited by examiner

AIR INTAKE DUCT

TECHNICAL FIELD

The present invention relates to an air intake duct adapted to be arranged at an air intake portion of a vehicle engine.

BACKGROUND ART

In recent years, in view of an increasing demand for traffic noise reduction, there has been a demand for reducing intake noises generated at an air intake portion of a vehicle engine. At the air intake portion of the engine, an air intake duct is provided. The intake noises are amplified by pipe resonance generated inside the air intake duct, and are radiated from an air intake port. Therefore, conventionally, in order to reduce the intake noises, a "resonant type muffler" called as a resonator or a side branch is provided.

However, in an engine room, a number of devices such as various auxiliary devices of the engine and electronic devices for reducing exhaust gas are provided. Therefore, available space inside the engine room is limited, and it is difficult to provide a space for installing the resonant type muffler. In view of this, Patent Document 1 proposes an air intake duct having openings in the middle of a duct body, the openings being covered with a sheet member of heat-shrinkable fibers to reduce intake noises originating from pipe resonance.

Patent Document 1: JP 2000-282985 A

SUMMARY OF THE INVENTION

According to the air intake duct of Patent Document 1, the duct body is inserted into a cylindrical sheet member having a slightly larger size than the duct body, and the sheet member is heated and shrunk, whereby the sheet member is attached to the duct body such that the sheet member covers the openings. That is, according to the air intake duct of Patent Document 1, when attaching the sheet member, the sheet member needs to be heated. Therefore, manufacturing facilities require a heating apparatus, and a sheet member attaching process is cumbersome.

Also, because the air permeability of the sheet member changes before and after the heat shrinkage, it is difficult to control the air permeability of the sheet member after the heat shrinkage to be optimum in accordance with the opening ratio of the openings. Therefore, it is difficult to achieve desired noise reduction and airtightness. There is also a downside in that the duct body may deform due to the heating of the sheet member.

Further, according to the air intake duct of Patent Deference 1, the entire sheet member is exposed to the outside. Therefore, when mounting the air intake duct to a vehicle, extra care is required so as not to damage the sheet member, which makes it difficult to handle the air intake duct during the assembling operation. Moreover, because the sheet member is held by its own shrinking force, the sheet member can easily be displaced from the duct body, so that it may slip off during its use.

The present invention has been made in view of the problems described above, and in particular, it is an object thereof to provide an air intake duct having an easily attachable cover member.

To solve the problem described above, the present invention provides the following. (1) An air intake duct includes a duct body having an air flow passage communicating from one end to the other end of the duct body and a vent hole communicating from the air flow passage to the outside, an air permeable cover member arranged to cover the vent hole, and a holding member extending along an outer circumferential surface or an inner circumferential surface of the duct body to secure the cover member to the duct body. The holding member holds a portion of the cover member at a location different from the vent hole of the duct body. According to this aspect of the invention, the cover member can easily be attached to the duct body with the vent hole being covered by the cover member, simply by holding by the holding member. Also, according to this air intake duct, the cover member is held by the holding member, whereby the cover member is less likely to be displaced and can be protected by the holding member.

(2) The air intake duct as set forth in (1), in which at least one end portion of the holding member is detachably attached to the duct body. According to this aspect of the invention, the holding member can easily be attached to the duct body.

(3) The air intake duct as set forth in (1) or (2), in which the outer circumferential surface or the inner circumferential surface of the duct body is formed with a pair of ribs opposed to each other across the vent hole and extending in a circumferential direction of the duct body, and the holding member is fitted between the pair of ribs. According to this aspect of the invention, because the holding member is positioned by the pair of ribs, the cover member is even less likely to be displaced.

(4) The air intake duct as set forth in any one of (1) to (3), in which the holding member extends in the circumferential direction of the air flow passage of the duct body, t a locking portion provided on at least one end of the holding member in the circumferential direction, and a lock receiving portion to which the locking portion is secured is provided on the duct body. According to this aspect of the invention, the holding member can be attached to the duct body with a simple structure.

(5) The air intake duct as set forth in (4), in which hinge portion is provided on another end of the holding member in the circumferential direction, the holding member is rotatable with respect to the duct body around the hinge portion serving as a rotation center, and the hinge portion is formed as a one-piece structure together with the duct body and the holding member. According to this aspect of the invention, the holding member can be attached to the duct body by a simple structure and with a reduced number of components.

(6) The air intake duct as set forth in any one of (1) to (5), in which an opening portion is provided in the holding member at a location corresponding to the vent hole of the duct body, the holding member includes a pair of holding portions opposed to each other across the opening portion, and the pair of holding portions presses the cover member against the duct body such that a tension is applied to the cover member. According to this aspect of the invention, the cover member is pressed against the duct body by the holding member with the tension being applied to the cover member. Therefore, deformation of the cover member at a portion corresponding to the vent hole can be suppressed, thereby effectively reducing noises from the air intake duct.

(7) The air intake duct as set forth in (6), in which the duct body is formed with holding receiving portions at locations corresponding to the holding portions. According to this aspect of the invention, because the holding member presses the cover member against the holding receiving portions, the tension can be applied to the cover member in a more reliable manner.

(8) The air intake duct as set forth in (6) or (7), in which an end of the holding member in the circumferential direction is rotatably mounted on the duct body, and when the holding member rotates, one of the pair of holding portions that is near a rotation center of the holding member holds the cover member earlier than the other holding portion that is far from the rotation center. According to this aspect of the invention, the holding member rotates such that one of the holding portions presses the cover member against the duct body first and such that the other holding portion applies the tension to the cover member. Therefore, simply by rotating the holding member, the cover member can be held on the duct body with the tension being applied.

(9) The air intake duct as set forth in (8), in which the holding portions are protrusions protruding from the holding member toward the duct body, and the holding portion that is near the rotation center of the holding member has a higher protrusion height than the holding portion that is far from the rotation center of the holding member. When the holding member rotates, the holding portion that is near the rotation center holds the cover member earlier than the holding member that is far from the rotation center. Therefore, the tension can be applied to the cover member in a more reliable manner.

(10) The air intake duct as set forth in any one of (1) to (5), in which an opening portion is provided in the holding member at a location corresponding to the vent hole of the duct body, a holding portion is provided on an outer periphery of the opening portion of the holding member, a holding receiving portion corresponding to the holding portion is provided on an outer periphery of the vent hole of the duct body, and the holding portion and the holding receiving portion hold the cover member between the holding portion and the holding receiving portion and apply a tension to the cover member. According to this aspect of the invention, tension can be applied to the cover member in an area corresponding to the vent hole. Therefore, deformation of the cover member at a portion corresponding to the vent hole can be suppressing, thereby effectively reducing noises from the air intake duct.

(11) The air intake duct as set forth in (10), in which, when the holding member secures the cover member to the duct body, an outer side portion of the holding receiving portion is pressed by an inner side portion of the holding portion via the cover member. According to this aspect of the invention, the tension can be applied to the cover member in a more reliable manner.

EMBODIMENTS OF THE INVENTION

<First Embodiment

An air intake duct 10 according to a first embodiment of the present invention will be described with reference to the accompanying drawings. In the following description, with respect to the air intake duct, a direction along which the air flows through the air flow passage is referred to as a longitudinal direction, a direction perpendicular to the longitudinal direction is referred to as a radial direction, and a direction around the longitudinal direction as an axis is referred to as a circumferential direction.

Figure 1:
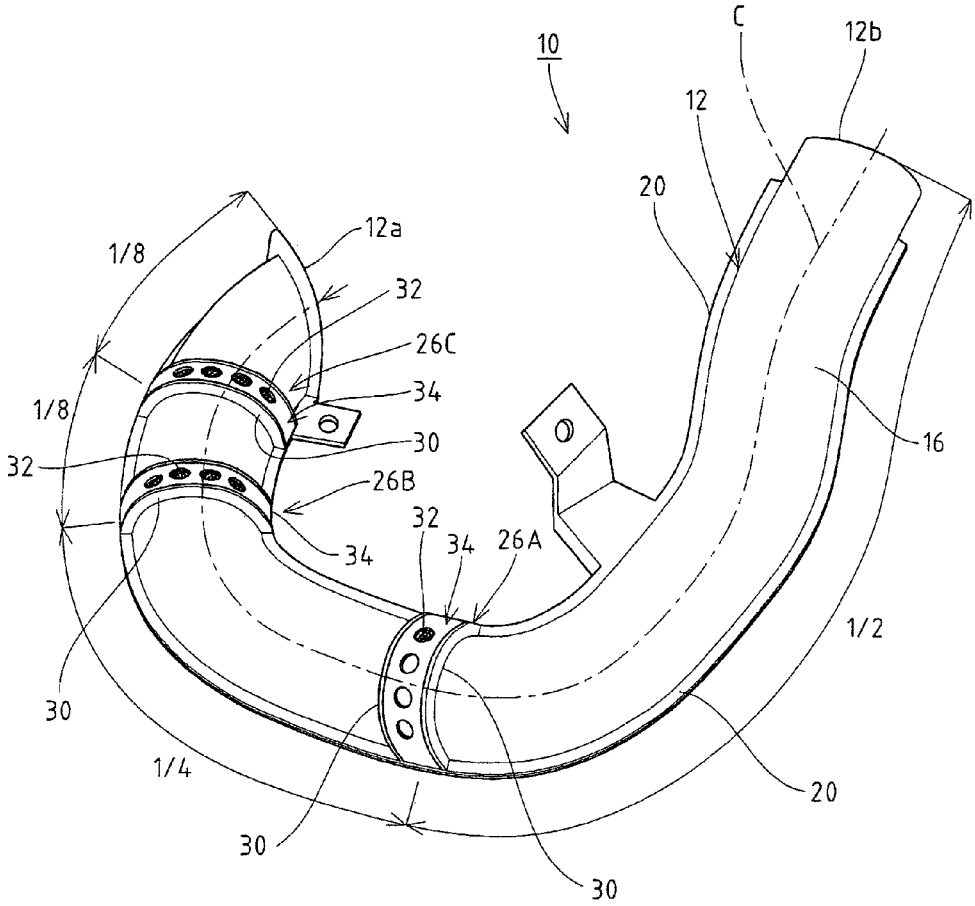
FIG. 1 is a schematic perspective view of an air intake duct according to a first embodiment of the present invention.
Figure 2:
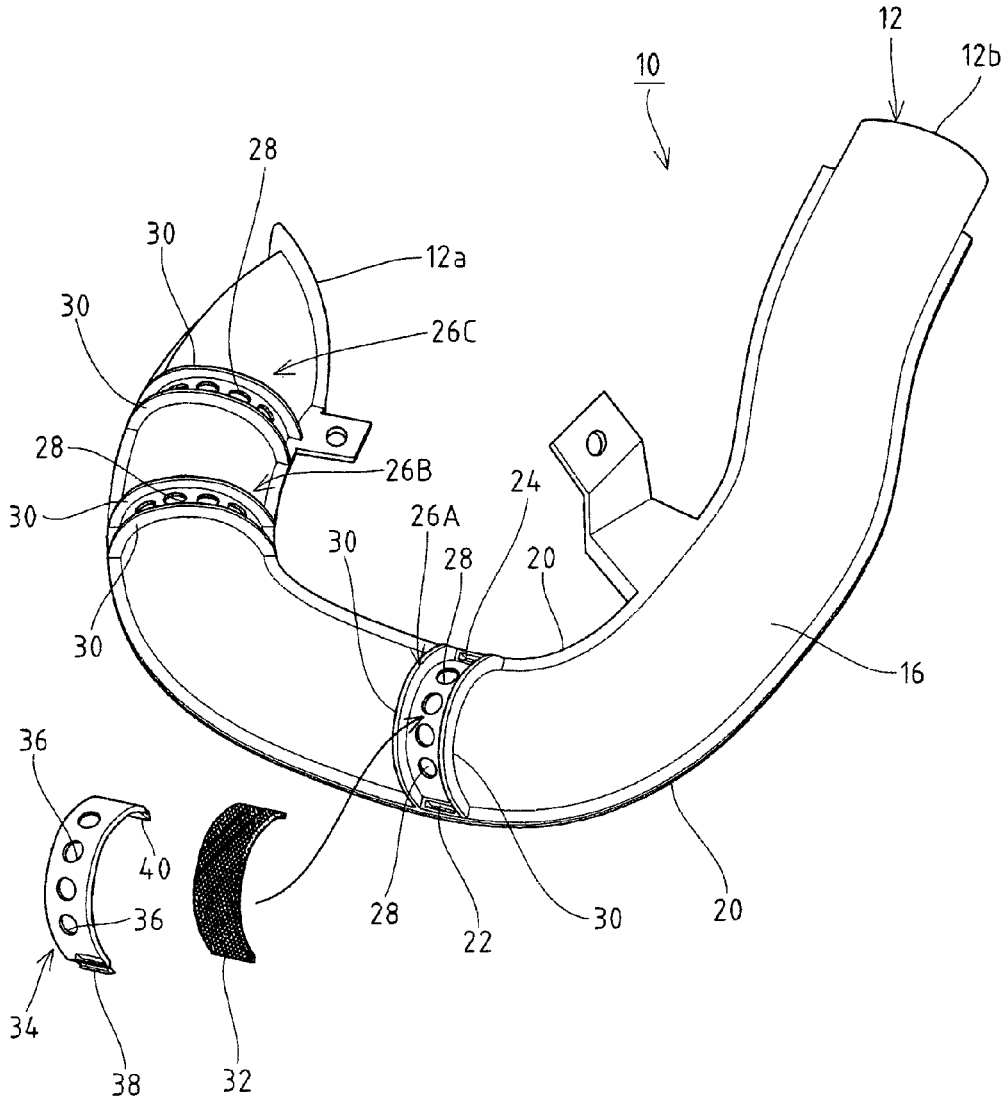
FIG. 2 is another schematic perspective view of the air intake duct shown in FIG. 1, with a cover member and a holding member being removed.

As shown in FIGS. 1 and 2, the air intake duct 10 includes a cylindrical duct body 12 having vent holes 28, cover members 32 covering the vent holes 28, and holding members 34 securing the cover members 32 to the duct body 12. Inside the duct body 12, there is formed an air flow passage 14 (see FIG. 3) provided with an inlet port 12*a* on one end and an outlet port 12*b* on the other end. The air intake duct 10 is attached to a vehicle engine room such that the inlet port 12*a* of the duct body 12 faces the outside of the vehicle and such that the outlet port 12*b* of the duct body 12 is coupled to an apparatus such as an air cleaner.

Figure 3:
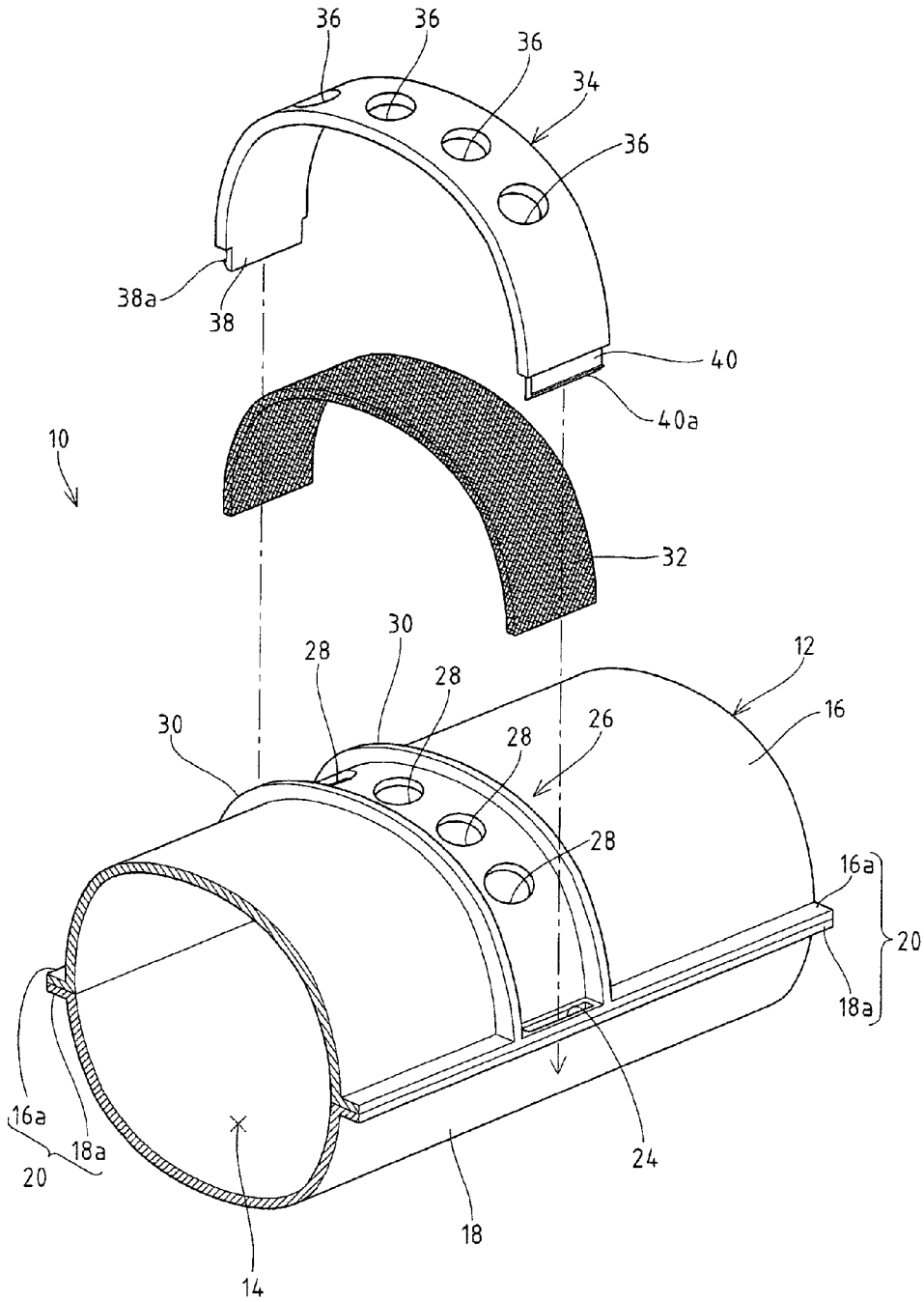
FIG. 3 is a perspective view of a main portion cut out from the air intake duct shown in FIG. 1, with the cover member and the holding member being removed.

As shown in FIG. 3, the duct body 12 is a substantially cylindrical member. The duct body 12 is formed by combining a first half body 16 having a semicircular sectional shape and a second half body 18 also having a semicircular sectional shape. The first half body 16 and the second half body 18 are made of a synthetic resin such as polypropylene (PP) or polyethylene (PE), and are airtight members formed by injection molding or the like.

On the respective circumferential end portions of the first half body 16 and the second half body 18, flange portions 16*a*, 18*a* protruding outward in the radial direction and extending along the longitudinal direction are formed. The duct body 12 is assembled by joining the flange portions 16*a*, 18*a* of the first half body 16 and the second half body 18 in a face to face manner. The flange portions 16*a*, 18*a* may be joined together by vibration welding, bonding using an adhesive, or by mechanical fastening means such as a rivet, a bolt or the like.

The mutually joined flange portions 16*a*, 18*a* form a flange 20 extending in the longitudinal direction. As shown in FIG. 2, this flange 20 is formed at two locations spaced from each other in the circumferential direction. That is, the air intake duct 10 has two flanges 20, 20 symmetrically arranged across the air flow passage 14.

The duct body 12 is provided with the vent holes 28 that communicate from the air flow passage 14 to the outside (see FIG. 2). Each of the vent holes 28 has a circular shape (see FIG. 2 or 3), and its diameter is preferably in the range of 5 mm to 16 mm. As shown in the drawings, all of the vent holes 28 may have the same dimension. A plurality of (four in the illustrated example) vent holes 28 are arranged in a spaced manner along the circumferential direction of the duct body 12 to form a set of openings 26. With regard to the number of sets of openings 26, a plurality of sets (in this example, three sets) may be provided so as to be spaced from each other in the longitudinal direction as shown in the drawings, or only one set may be provided.

In the example shown in FIG. 2, the vent holes 28 of each set of openings 26 are arranged on the circumferential surface of the duct body 12 such that the respective center line lengths from the inlet port 12*a* are the same. Specifically, the vent holes 28 are arranged such that, in each set of openings 26, the centers (the weighted centers) of the circular vent holes 28 are aligned in the circumferential direction. Here, the center line C of the duct body 12 is a virtual line passing through the center of the air flow passage 14 along the longitudinal direction. The center line length is the length of this center line C (see FIG. 1). In the illustrated example, the vent holes 28 are formed only in the first half body 16, so that the sets of openings 26 are formed in the first half body.

In the example shown in FIG. 2, the duct body 12 is formed with three sets (at least two sets) of openings 26A, 26B, 26C. Among these sets, the first set of openings 26A is provided at a location at half of the center line length from the inlet port 12*a* to the outlet port 12*b*. The second set of openings 26B is provided at a location at half of the center line length from the inlet port 12*a* to the first set of openings 26A, and the third set of openings 26C is provided at a location at half of the center line length from the inlet port 12*a* to the second set of openings 26B.

That is, the air intake duct 10 has at least one set of openings 26A at a location at half of the entire center line length. Further, another set of openings 26B (26C) is arranged at the middle position between the inlet port 12*a* and the set of openings 26A (26B) nearest to the inlet port 12*a*. In this manner, the sets of openings 26A to 26C (the vent holes 28) are arranged at positions, such as one half, a quarter, one-eighth and the like of the center line of the duct body 12, at which the phases of pipe resonances are superimposed so that the sound pressure level becomes high. Therefore, the air intake duct 10 releases the pressure pulsation in the air flow passage 14 outside through the vent holes 28, thereby suitably dampening the pipe resonance.

The vent holes 28 are designed such that the total opening lengths in the circumferential direction is in the range of 13% to 67% of the circumferential length of the duct body 12. Here, the opening length of each of the vent holes 28 in the circumferential direction is the length of the vent hole 28 in circumferential direction that passes through the weighted center thereof, and in the illustrated example, it is the diameter of the vent hole 28. The total opening lengths is a sum of the opening lengths of the vent holes 28 of the set of openings 26 in the circumferential direction. In the illustrated example, the vent holes 28 having the same shape and same dimension are arranged in the circumferential direction of the duct body 12. Thus, the total opening length is a sum of the diameters of the vent holes 28 of the set of openings 26.

If the total opening length is below 13% of the circumferential length of the duct body 12, the pressure pulsation of the air flow passage 14 cannot be released outward through the vent holes 28 in a suitable manner, so that sufficient dampening effect of the pipe resonance cannot be obtained. On the other hand, if the total opening length exceeds 67% of the circumferential length of the duct body 12, the air flowing in the air flow passage 14 leaks through the vent holes 28 such that the pressure loss increases, in which case the air cannot efficiently be guided to the engine. Further, if the total opening length exceeds 67% of the circumferential length of the duct body 12, the sound leakage through the vent holes 28 is also increased, and the strength of the air intake duct 10 is lowered.

The cover member 32 is an air permeable member. The cover member 32 may be a foam member, such as urethane foam, rubber or the like, having an open-cell structure, a porous member, such as a resin film, having minute openings, a fiber assembly, such as nonwoven fabric, a meshed member, or the like. Among others, the nonwoven fabric having a water-repellent surface is preferred. The nonwoven fabric is preferably be made of polyester fibers or polypropylene fibers by a span bond method or a needle punch method, and the density thereof is preferably in the range of 30 $g/m^2$ to 300 $g/m^2$.

The dimensions of the cover member 32 in the longitudinal and circumferential directions are larger than the dimensions of the vent holes 28 in the longitudinal and circumferential directions, so that the cover member 32 can cover the vent holes 28. The circumferential dimension of the cover member 32 may be set substantially the same as the spacing width between the flanges 20, 20 in the circumferential direction (half of the circumference of the duct body 12). The cover member 32 is a strip of a sheet (see FIG. 2 or 3). The cover member 32 is arranged on the outer circumferential surface of the duct body 12 such that the long sides thereof extend along the circumferential direction of the air intake duct 10. The cover member 32 arranged in this manner is held on the duct body 12 by the holding member 34 in a state in which it covers the vent holes 28.

The holding members 34 are attached at locations corresponding to the respective sets of openings 26 of the duct body 12 (see FIG. 2). Each of the holding member 34 is made of synthetic resin, such as polypropylene (PP) or polyethylene (PE), or rubber, and is formed is a shape of a strip having the long sides extending in the circumferential direction (see FIG. 3).

The dimension of the short sides of the holding member 34 (the dimension in the longitudinal direction of the duct body 12) is larger than the dimension of the vent hole 28 is the longitudinal direction, and is also larger than the dimension of the short sides of the cover member 32 (the dimension in the longitudinal direction of the duct body 12). The dimension of the long sides of the holding member 34 (the dimension in the circumferential direction of the duct body 12) is equal to or larger than the dimension of the cover member 32 in the circumferential direction. The dimension of the long sides of the holding member 34 may be substantially equal to the spacing width between the flanges 20, 20 in the circumferential direction (half of the circumference of the duct body 12).

In this manner, the holding member 34 is designed to have a size that is capable of covering all the vent holes 28 of the corresponding set of openings 26 and that is larger than the cover member 32 for the corresponding set of openings 26. The holding member 34 may be formed to have a shape that fits the outer circumferential surface of the duct body 12 in advance. Alternatively, the cover member may be made of a flexible or elastic member, so that the holding member 34 is deformed along the outer circumferential surface of the duct body 12 when attached to the duct body 12.

At least one end portion of the holding member 34 is detachably attached to the duct body 12. The holding member 34 is formed with an opening portion (an opening) 36 having a size that conforms to the vent hole 28 of the duct body 12. This opening portion 36 is formed at a location which, when the holding member 34 is secured onto the outer circumferential surface of the duct body 12, faces the vent hole 28.

Therefore, in a state in which the holding member 34 is mounted on the outer circumferential surface of the duct body 12, portions of the cover member 32 that correspond to the vent holes 28 are exposed to the outside through the opening portions 36, and a portion of the cover member 32 at a location different from the vent holes 28 is held by the holding member 34. In other words, the cover member 32 is covered and protected by the holding member 34, except the portions that correspond to the vent holes 28. The opening portion 36 of the holding member 34 need not be formed to have the same shape as the vent hole 28, and may be formed to have an opening that is at least larger than the vent hole 28.

Figure 5:
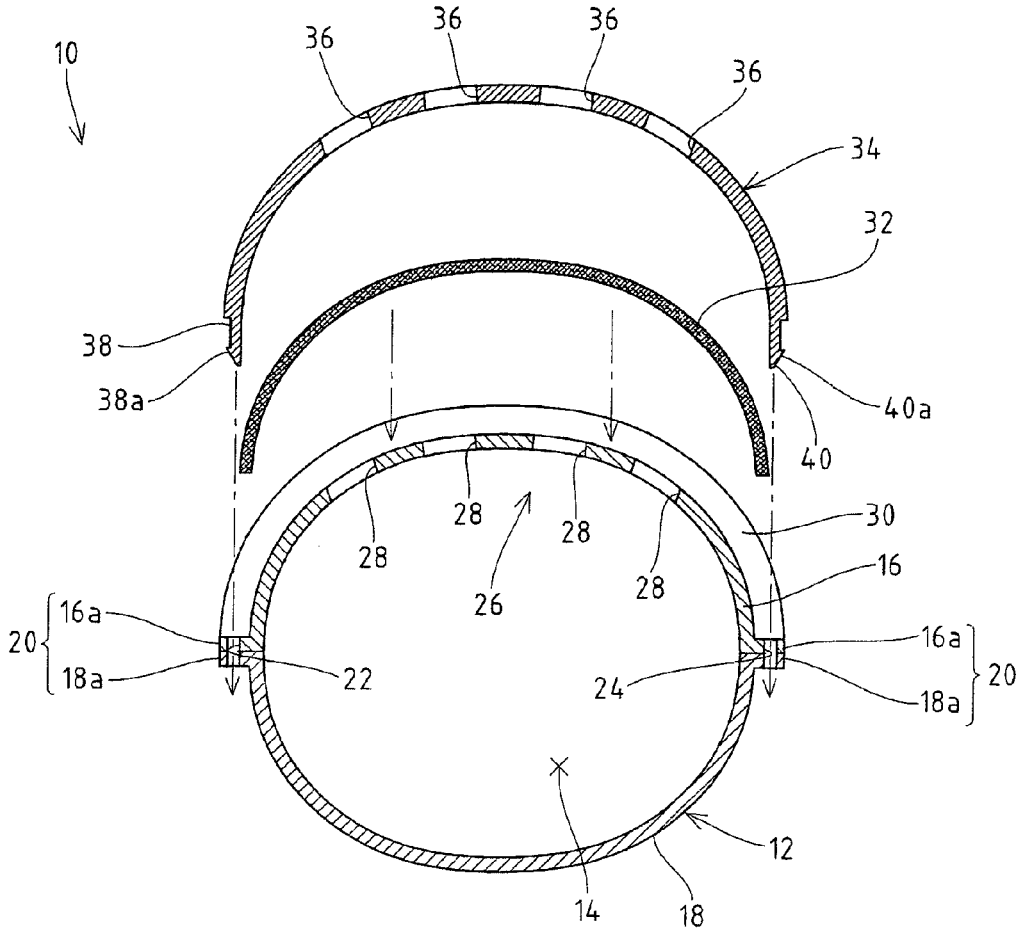
FIG. 5 is another sectional view of the air intake duct shown in FIG. 1, with the cover member and the holding member being removed.

As shown in FIG. 5, the holding member 34 has a first pawl portion (a locking portion) 38 at one end portion in the circumferential direction. This first pawl portion 38 is engaged with a first pawl hole (a lock receiving portion) 22 formed in the flange 20. The holding member 34 also has a second pawl portion 40 at the other end portion in the circumferential direction. This second pawl portion 40 is detachably engaged with a second pawl hole 24 formed in the other flange 20, which is next to the flange 20, having the first pawl hole 22, in the circumferential direction.

Figure 4:
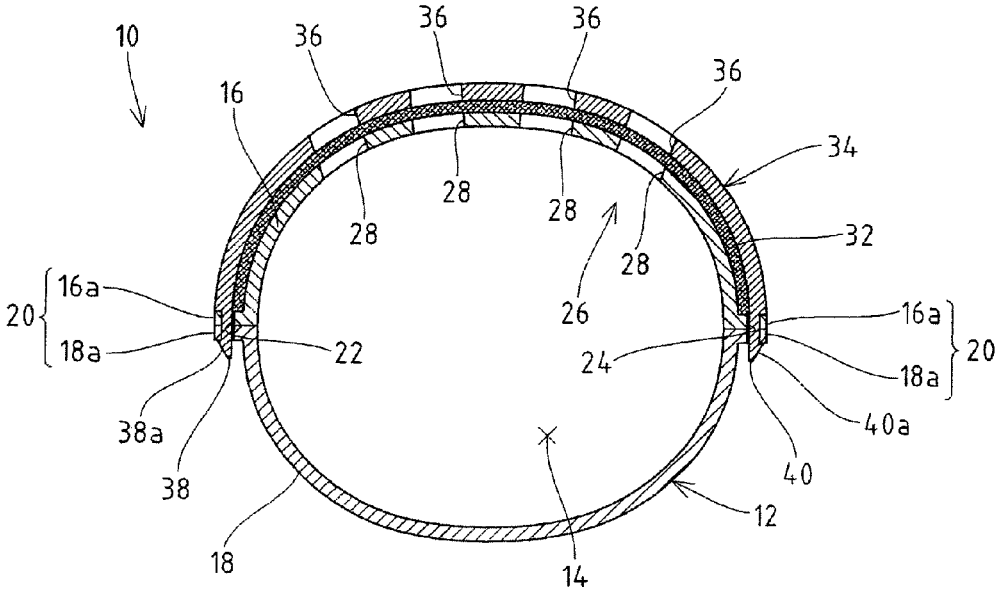
FIG. 4 is a sectional view of the air intake duct shown in FIG. 1.

The first pawl hole 22 and the second pawl hole 24 are openings formed through the flanges 20, and are spaced from each other in the circumferential direction. On the other hand, the first pawl portion 38 and the second pawl portion 40 are formed to have hook shapes, including tongues extending in the circumferential direction from the end portions of the holding member 34 and protrusion elements 38*a*, 40*a* protruding from distal ends of the tongues in directions intersecting the direction of insertion into the pawl holes 22, 24. When the first and second pawl portions 38, 40 are pushed into the first and second pawl holes 22, 24 respectively, the protrusion elements 38*a*, 40*a* of the first and second pawl portions 38, 40 are caught by the edges of the first and second pawl holes 22, 24, whereby the holding member 34 is held by the flanges 20 as shown in FIG. 4.

The duct body 12 further includes a pair of ribs 30, 30 extending in the circumferential direction such that the vent holes 28 are interposed between the ribs 30, 30. By placing the cover member 32 between the pair of ribs 30, 30 and fitting the holding member 34 such that the holding member 34 faces the vent holes 28, the holding member 34 can hold the cover member 32 and can be secured onto the outer circumferential surface of the duct body 12 (see FIG. 1 or 3).

More specifically, the pair of ribs 30, 30 are provided on the outer circumferential surface of the first half body 16 that has the vent holes 28 so as to extend from one flange portions 16*a* to the other flange portion 16*a*. The pair of ribs 30, 30 is arranged such that the spacing distance therebetween is the same as the dimension of the short sides of the holding member 34 (the dimension in the longitudinal direction of the duct body 12). Each of the ribs 30, 30 is formed to protrude from the outer circumferential surface of the duct body 12 such that it is higher than the thickness of the cover member 32.

(Functions) Next, functions of the air intake duct 10 will be described. By covering the vent holes 28 of the duct body 12 by the air permeable cover member 32, the air intake duct 10 can release the pressure pulsation in the air flow passage outside through the vent holes 28 and the cover member 32, and can dampen the pipe resonance. This can reduce the generation of noises caused by the pipe resonance. Further, because the vent holes 28 are covered by the cover member 32, the noise leakage from the vent holes 28 can be suppressed as compared with a case in which the vent holes 28 are exposed directly to the outside.

The cover member 32 is held by the holding member 34 that is secured to the duct body 12. This can eliminate the need of a heating device for attaching the cover member like the heat shrinkable sheet member described as the conventional example, thereby simplifying the manufacturing facilities. Also, because the heating is not necessary to attach the cover member 32, deformations of the duct body 12 and the cover member 32 can be avoided.

Further, the cover member 32 can be held simply by securing the holding member 34 to the duct body 12. Therefore, the process of attaching the cover member 32 can be simplified. Especially, the holding member 34 can be attached to the duct body 12 simply by inserting the first and second pawl portions 38, 40 into the first and second pawl holes 22, 24 of the duct body 12. Thus, the assembling efficiency is further improved.

The cover member 32 is firmly held by the holding member 34, so that its position is less likely to be shifted. Therefore, a stable noise reduction effect can be expected for a long period of time, regardless of vibrations of the vehicle or the like. The outer side of the cover member 32, except for the portions that correspond to the vent holes 28, is covered and protected by the holding member 34. The portions of the cover member 32 that correspond to the vent holes 28 and exposed to the outside are also located inward in the radial direction than the outer surface of the holding member 34. Therefore, the cover member 32 is less likely to be damaged by contacting other members or human hand during the transportation or mounting of the air intake duct 10 or the maintenance of the vehicle. That is, the holding member 34 functions not only to hold the cover member 32 but also to protect the cover member 32, so that the position shift and damage of the cover member 32 can efficiently be suppressed.

The holding member 34 has the opening portions 36 at locations that correspond to the vent holes 28 when it is secured to the duct body 12. Therefore, the air permeability of the cover member 32 is not deteriorated by the holding member 34. Further, because the portion of the cover member 32 is held between the duct body 12 and the holding member 34 at locations different from the vent holes 28, the portions of the cover member 32 that correspond to the vent holes 28 is not compressed by the holding member 34. That is, a change in the air permeability of the cover member 32 before and after the attachment can be suppressed. Therefore, the cover member 32 can be attached to the duct body 12 such that optimum air permeability corresponding to the openings of the vent holes 28 is maintained, thereby achieving desired noise reduction effect and air intake performance.

Further, the duct body 12 includes the pair of ribs 30, 30 interposing the vent holes 28 therebetween, and when the cover member 32 and holding member 34 are fitted between these ribs 30, 30, the positions thereof are determined accordingly. Therefore, they can easily be attached to the duct body 12. Also, by designing the dimension of the cover member 32 in the circumferential direction in accordance with the spacing distance between the flanges 20, 20 in the circumferential direction, the cover member 32 can easy be positioned between the flanges 20, 20.

In this manner, the set of openings 26 is surrounded by the ribs 30, 30 and the flanges 20, 20, and the cover member 32 is arranged in this surrounded space. Therefore, the holding member 34 can easily be attached, and it is possible to avoid attaching failure, such as displacement of the cover member 32 from the vent holes 28. It is also possible to avoid other attaching failures, such as a displacement of the holding member 34 from the cover member 32, or a displacement of the holding member 34 from its proper position and resulting in covering of the vent holes 28.

(Test Examples) Changes in noise reduction effect depending on the opening ratio of the vent hole were tested. Each of test examples 1 to 5 of air intake ducts was prepared by providing a straight pipe duct body having a diameter of 71 mm and a center line length of 400 mm from the inlet port to the outlet port, forming vent holes at a location at one half of the center line length of the duct body from the inlet port to the outlet port, and covering the vent holes with a nonwoven fabric having a density of 100 g/m$^2$. Also prepared was a comparison example 1 having a duct body that is similar to the test examples but does not have vent holes, and a comparison example 2 in which the vent holes are not covered with nonwoven fabric.

With regard to the evaluation of the noise reduction effect, sound was input into the air intake duct from a sound source attached to the inlet port, and the sound volume was measured by a sound collector attached to the outlet port. It was evaluated as being effective, when there was a sound reduction amount of 20 dB or more in the frequency of 300 Hz to 600 Hz and when there was a sound reduction amount of 10 dB or more in the frequency of 600 Hz to 1200 Hz. The results are shown in Table 1 below.

TABLE 1

| | Test Examples | | | | | Comparative Examples | |
|---|---|---|---|---|---|---|---|
| | 1 | 2 | 3 | 4 | 5 | 1 | 2 |
| Vent Hole Diameter (mm) | — | 10 | 10 | 16 | 5 | N/A | 10 |
| Number of Vent Holes | 1 | 5 | 15 | 2 | 20 | — | 5 |
| Opening Area (mm$^2$) | 2375 | 392.5 | 1177.5 | 401.92 | 392.5 | — | 392.5 |
| Opening Length (mm) | 30 | 50 | 150 | 32 | 100 | — | 50 |
| Opening Ratio (%) | 13 | 22 | 67 | 14 | 45 | — | 22 |
| Effectiveness | ○ | ○ | ○ | ○ | ○ | x | x |

* The opening area is the total opening area of the vent holes.
* The opening length is the total opening length of the vent holes in the circumferential direction.
* The opening ratio is the ratio of the total opening length of the vent holes circumferential direction to the circumferential length of the duct body.

According to the results shown in Table 1, it was confirmed that, when the opening ratio of the vent holes to the circumferential length of the duct body is in the range of 13% to 67%, sufficient noise reduction effect can be obtained.

The present invention is not limited to the embodiment described above, and can also be modified as follows.

<Second Embodiment

Figure 6:
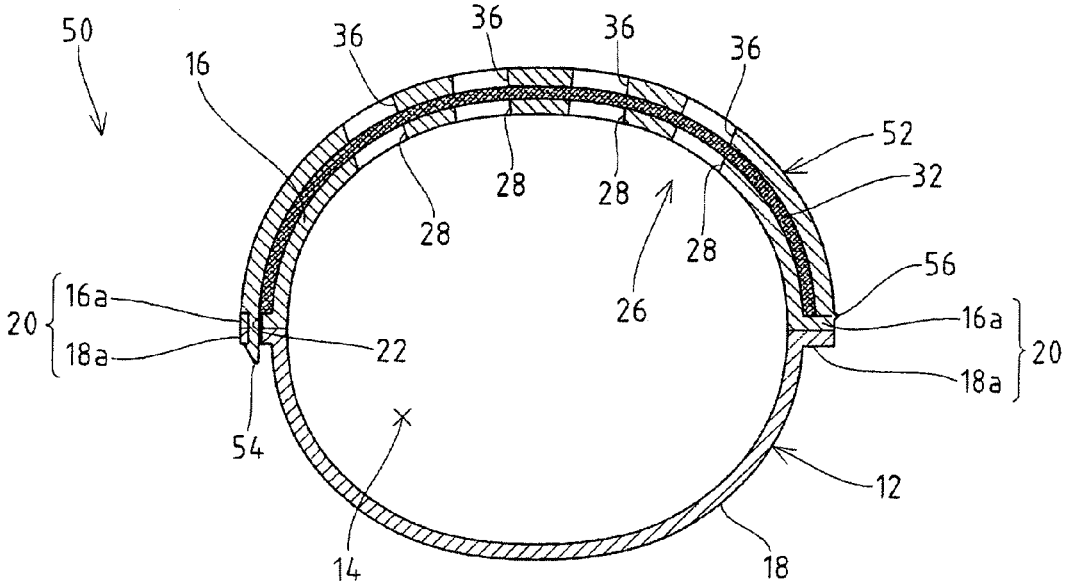
FIG. 6 is a schematic perspective view of an air intake duct according to a second embodiment of the present invention.
Figure 7:
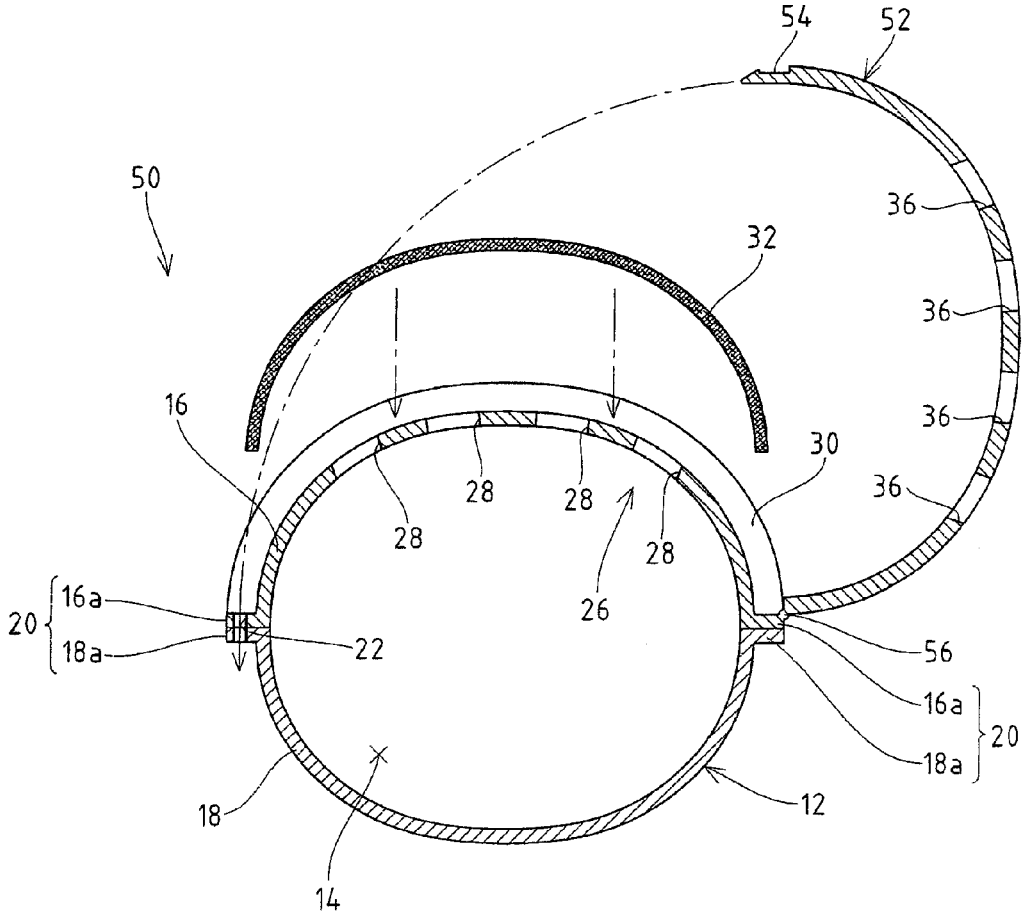
FIG. 7 is a sectional view of the air intake duct shown in FIG. 6, with a cover member and a holding member being removed.

The attaching structure for the holding member 34 in the air intake duct 10 according to the first embodiment is configured such that both end portions of the holding member 34 that are spaced in the circumferential direction are detachably attached to the duct body 12. However, only one of the end portions may be configured to be detachably attached. FIGS. 6 and 7 are sectional views of an air intake duct 50 according to a second embodiment of the present invention.

As shown in FIGS. 6 and 7, the holding member 52 of the air intake duct 50 is rotatably attached to the flange 20 of the duct body 12 at an end portion in the circumferential direction via a hinge portion 56. The hinge portion 56 is formed as a one-piece structure together with the first half body 16 of the duct body 12. By forming the holding member 52 and the first half body 16 as a one-piece structure, the number of components of the air intake duct 50 can be reduced, and so that the handling thereof can be further improved.

The holding member 52 configured in this manner is rotated relative to the duct body 12 with the hinge portion 56 serving as the fulcrum, and is held onto the duct body 12 by the engagement of a pawl portion (a locking portion) 54 provided on a side opposite to the hinge portion 56 with respect to the circumferential direction with the pawl hole (a lock receiving portion) 22 of the flange 20, such that the cover member 32 is held between the holding member 52 and the outer circumferential surface of the duct body 12.

<Third Embodiment

Figure 8:
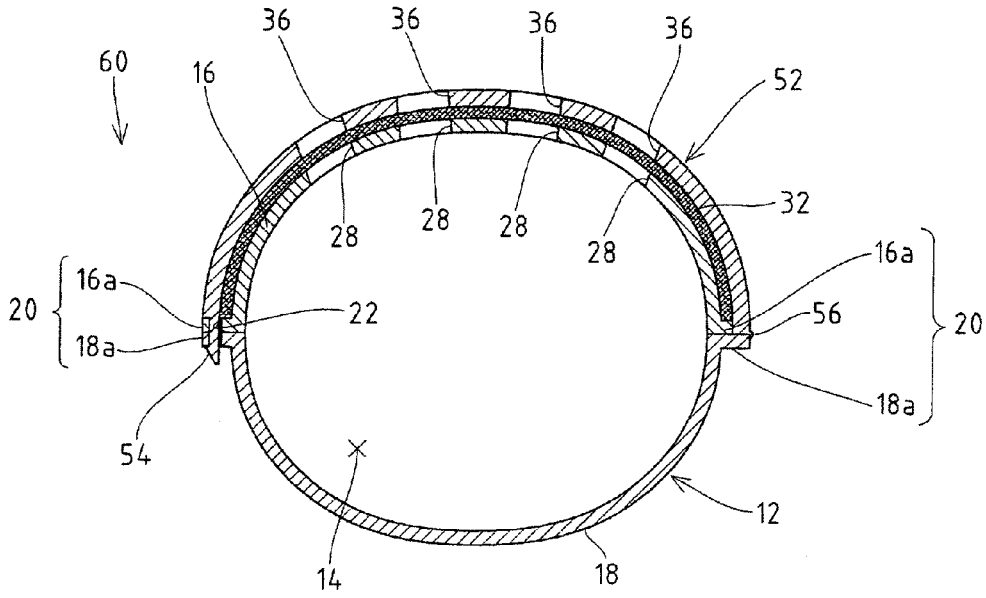
FIG. 8 is a sectional view of an air intake duct according to a third embodiment of the present invention.
Figure 9:
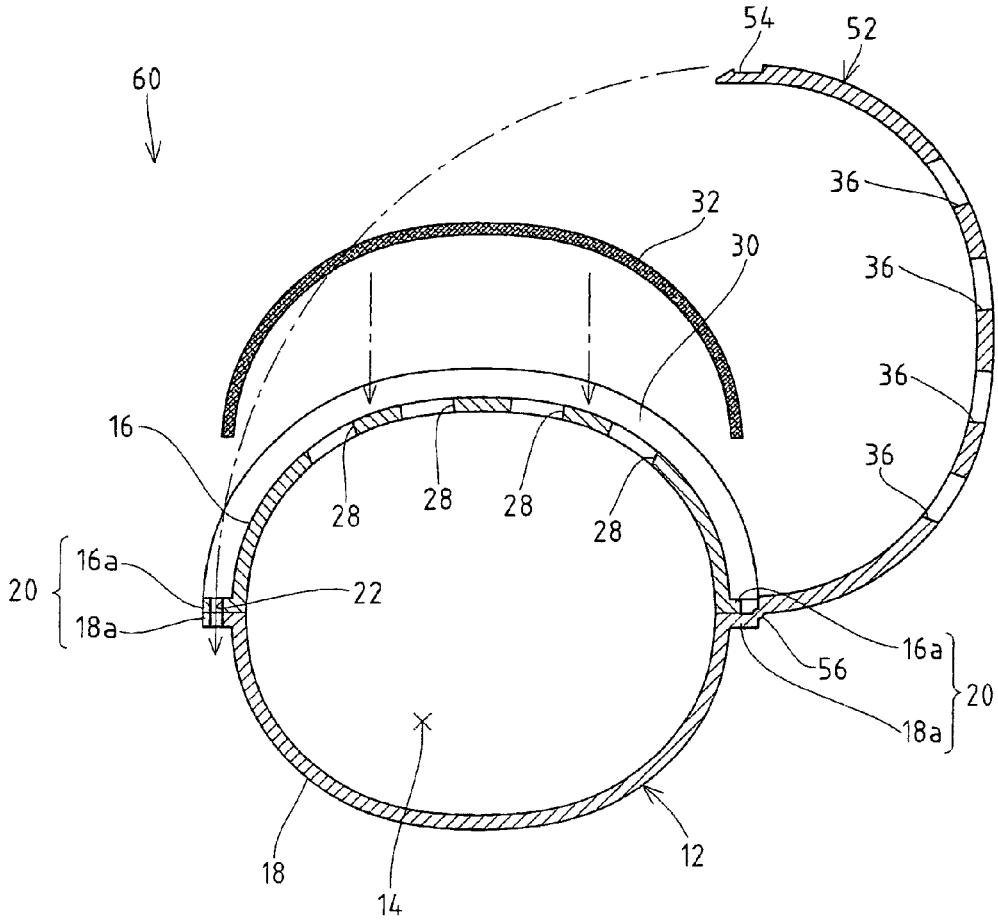
FIG. 9 is a sectional view of the air intake duct shown in FIG. 8, with a cover member and a holding member being removed.

While the air intake duct 50 according to the second embodiment is configured such that the hinge portion 56 connects the holding member 52 and the first half body 16, it may be configured such that the hinge portion 56 connects the holding member 52 and second half body 18, like an air intake duct 60 according to a third embodiment shown in FIGS. 8 and 9.

In the air intake duct 60 according to the third embodiment, the pawl portion 54 of the holding member 52, which is formed as a one-piece structure together with the second half body 18, is engaged with the pawl hole 22 provided in the second half body 18. Therefore, the holding member 52, which is integral with the second half body 18, can press the cover member 32 and the first half body 16 against the second half body 18. As a result, at the same time as securing the cover member 32 to the first half body 16, the first half body 16 and the second half body 18 can be secured together.

<Fourth Embodiment

Figure 10:
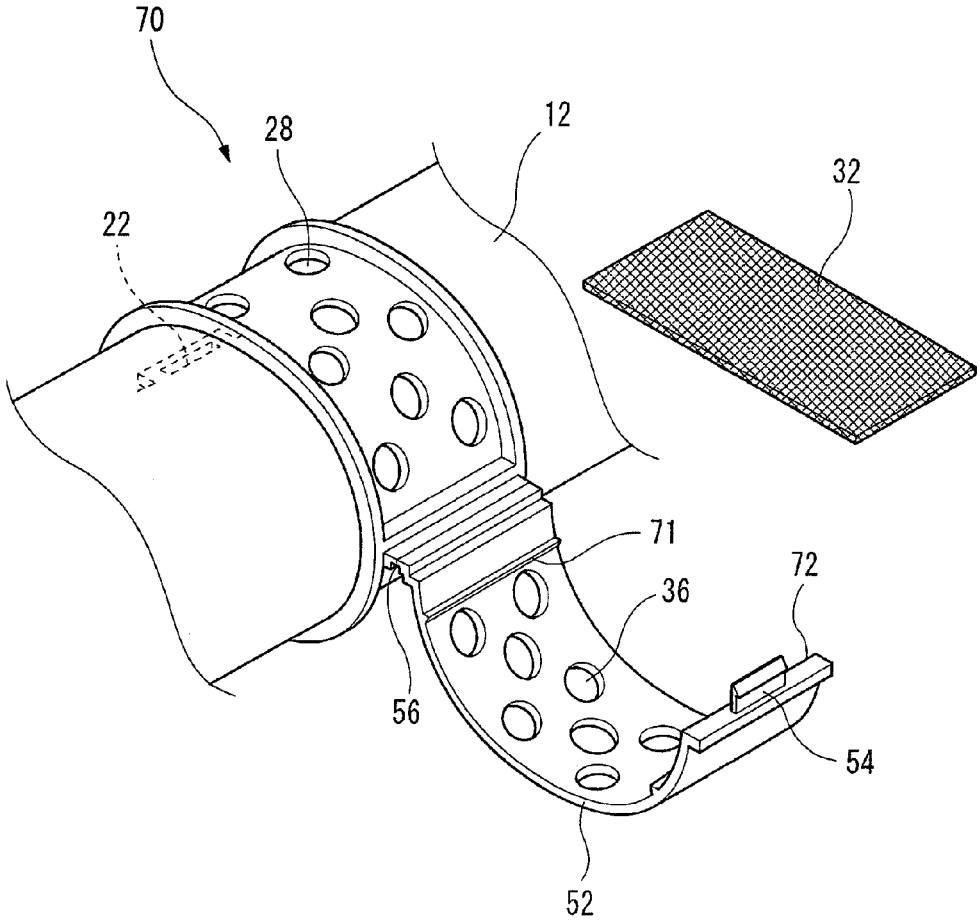
FIG. 10 is a perspective view of an air intake duct according to a fourth embodiment of the present invention.
Figure 11:
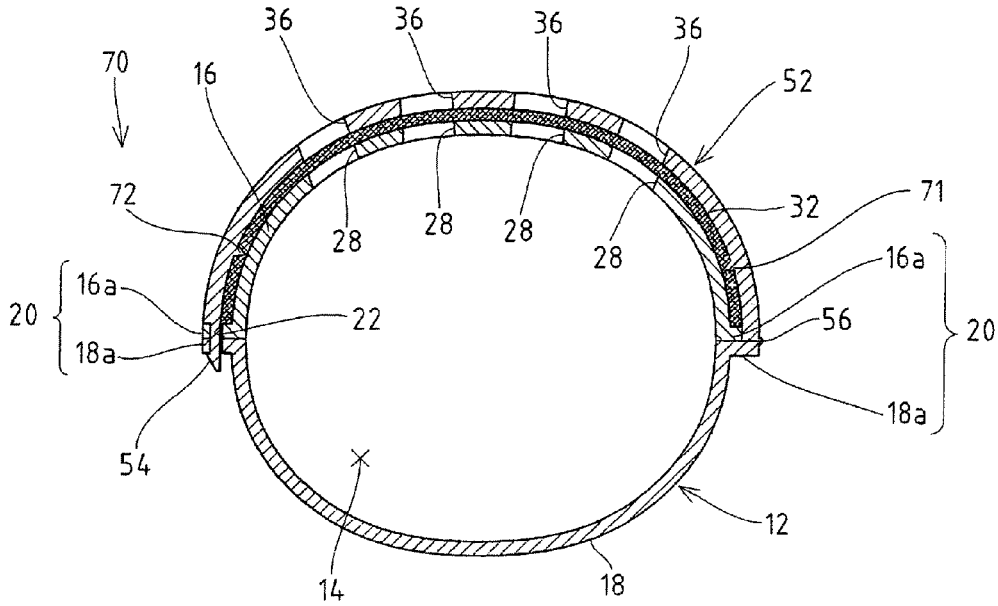
FIG. 11 is a sectional view of the air intake duct shown in FIG. 10.

FIG. 10 is a perspective view of an air intake duct 70 according to a fourth embodiment of the present invention, and FIG. 11 is a sectional view of the air intake duct 70, taken along a plane perpendicular to the longitudinal direction thereof. The air intake duct 70 according to the fourth embodiment is configured such that, in the air intake duct 60 according to the third embodiment, eight vent holes 28 form one set of openings 26, and a pair of protrusions (holding portions) 71, 72 are formed on the holding member 52 to hold the cover member 32.

According to the air intake duct 70, a plurality of vent holes 28 are arranged in a plurality of rows in the circumferential direction and in the longitudinal direction to form one set of openings 26. By arranging the vent holes 28 in a plurality of rows and not in a single row, the opening area can be ensured while maintaining high strength of the duct body 12.

The holding member 52 that covers the vent holes 28 is formed to extend along the circumferential direction, similarly to the first to third embodiments described above. One end of the holding member 52 in the circumferential direction is connected to the duct body 12 via the hinge portion 56, and the pawl portion 54 is provided on the other end in the circumferential direction and is detachably engaged with the pawl hole 22 of the duct body 12. In the vicinity of the hinge portion 56 of the holding member 52 (near the one end in the circumferential direction) and in the vicinity of the pawl portion 54 (near the other end in the circumferential direction), the pair of protrusions 71, 72 protruding toward the duct body 12 is provided. The pair of protrusions 71, 72 are opposed to each other across the opening portions 36, and extend in the longitudinal direction of the duct body 12.

According to the air intake duct 70 of the fourth embodiment, when rotating the holding member 52 around the hinge portion 56 to attach the cover member 32 to the duct body 12, firstly, the protrusion 71 near the hinge portion 56 contacts the cover member 32 and presses the cover member 32 against the outer circumferential surface of the duct body 12. In this state, a portion of the cover member 32 on a side of the hinge portion 56 is held between the protrusion 71 and the outer circumferential surface of the duct body 12.

When the holding member 52 is further rotated, the protrusion 72 near the pawl portion 54 contacts the cover member 32 and presses the cover member 32 against the outer circumferential surface of the duct body 12. When the holding member 52 is further rotated, the protrusion 72 moves while pulling a portion of the cover member 32 on a side of the pawl hole 22 toward the pawl hole 22. Finally, in a state in which the pawl portion 54 is engaged with the pawl hole 22 so that the holding member 52 is secured to the duct body 12, the holding member 52 is held on the duct body 12 such that a tension is applied to the cover member 32 by the pair of protrusions 71, 72.

By holding the cover member 32 with the tension applied in this manner, noises can be reduced more effectively. According to the air intake duct 70 of the fourth embodiment, because the tension is applied to the cover member 32, the deformation of the cover member 32 due to pressure variations in the inside of the duct body 12 can be suppressed. Therefore, the wear of the cover member 32 can be suppressed so that the noises can be reduced for a long period of time. Further, because no clearance is formed between the cover member 32 and duct body 12, the noises do not leak to the outside, so that the noises can further be suppressed.

If the cover member 32 is held with no tension being applied, an increase in pressure inside the air flow passage due to the pipe resonance may cause the cover member 32 to bulge from the vent holes 28, or a decrease in the pressure may cause the cover member 32 to deform in a sagging manner from the vent holes 28. In the event that the cover member 32 is deformed due to the pressure, especially if the opening portion 36 is larger than the vent hole 28, the cover member 32 may by worn by the outer circumference of the vent hole 28, or noises may leak to the outside from a clearance formed between the cover member 32 and duct body 12.

The structure for holding the cover member 32 is not limited to the protrusions 71, 72 described above. For example, the holding member 52 may be formed to have a thin area where the opening portions 36 are formed and a thick area at respective end portions in the circumferential direction, so that the cover member 32 is held by the step portions formed at the boundary between these areas.

Figure 12:
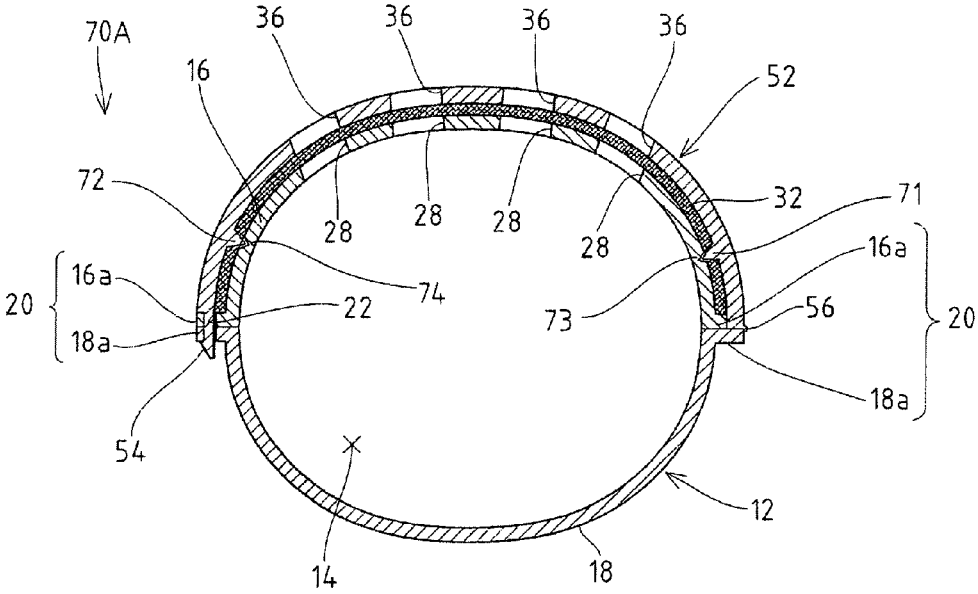
FIG. 12 is a sectional view of an air intake duct according to a first modification of the fourth embodiment of the present invention.

Further, the present embodiment is not limited to the example in which the protrusions 71, 72 are provided on the holding member 52. FIG. 12 is a sectional view of an air intake duct 70A according to a first modification of the fourth embodiment of the present invention. As shown in the sectional view of FIG. 12, groove portions (holding receiving portions) 73, 74 into which the protrusions 71, 72 are inserted may be formed in the duct body 12 at locations corresponding to the protrusions 71, 72.

Further, the protrusions 71, 72, may be provided continuously along the longitudinal direction of the duct body 12 as shown in FIG. 10, or may be provided intermittently. Preferably, the height of the protrusion 71 is larger than the height of the protrusion 72 so that, when the holding member 52 rotates while pulling the cover member 32 by the protrusion 72, the cover member 32 firmly held by the protrusion 71.

By modifying the shape of the outer circumferential surface of the duct body 12 and the shape of the inner circumferential surface of the holding member 52, or by modifying the attaching position of the hinge portion 56 of the holding member 52 with respect to the duct body 12, it can be configured such that the protrusion 71 near the rotation center of the holding member 52 holds the cover member 32 earlier than the protrusion 72 that is far from the rotation center.

Figure 13:
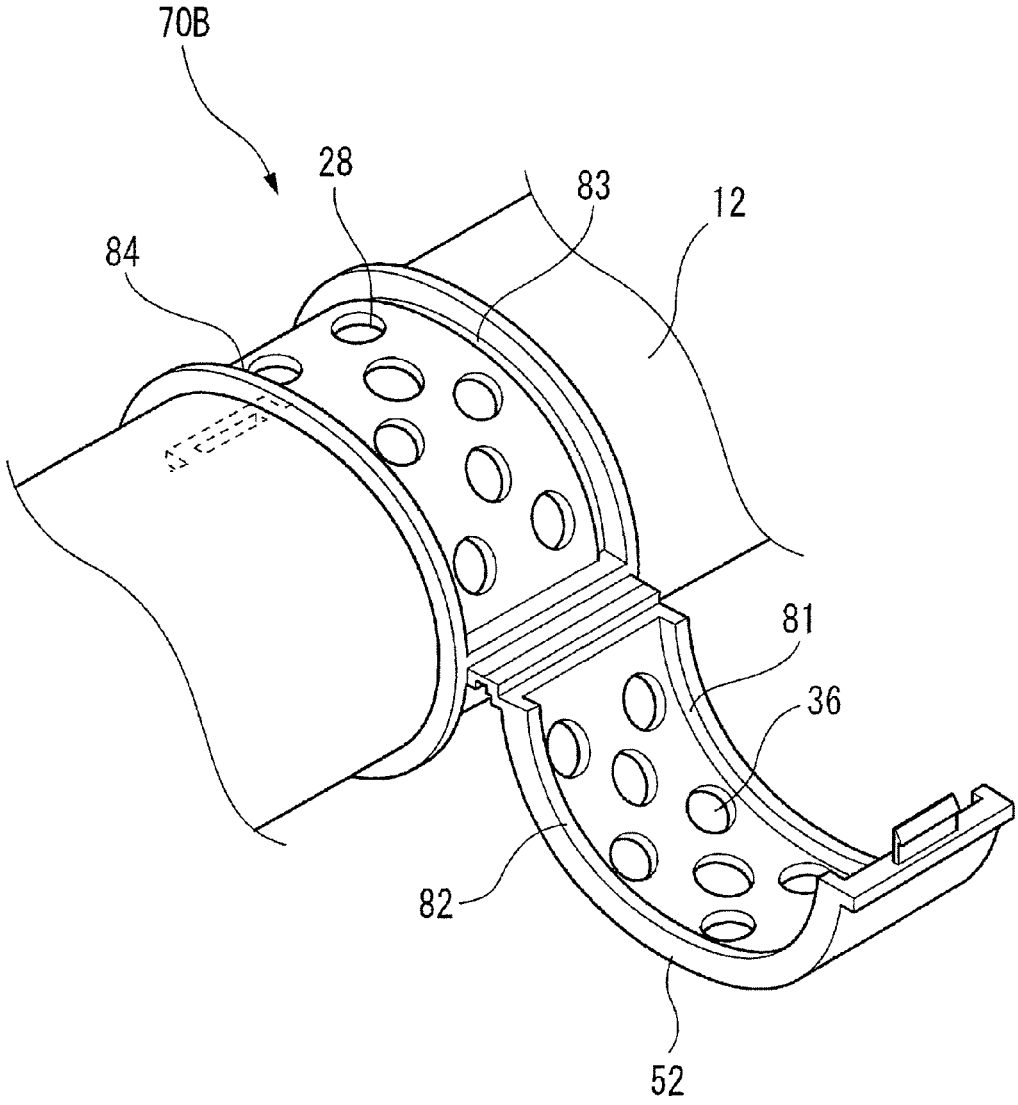
FIG. 13 is a perspective view of an air intake duct according to a second modification of the fourth embodiment of the present invention.
Figure 14:
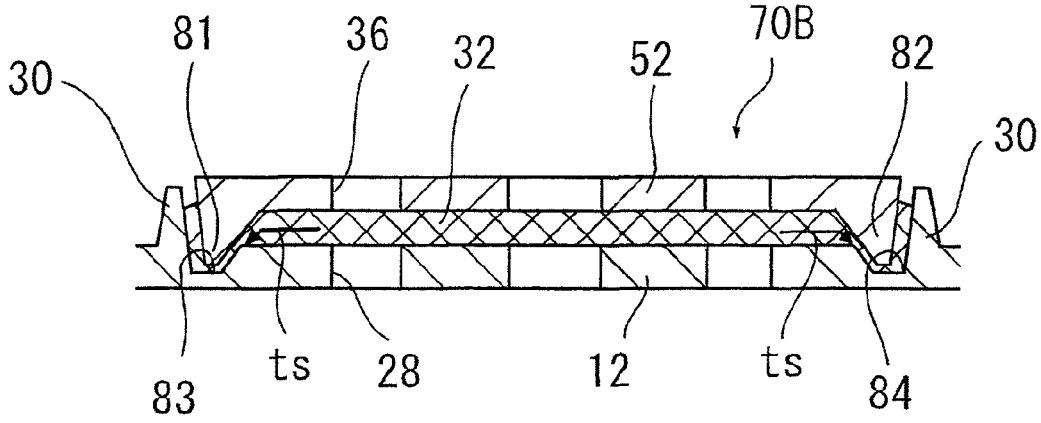
FIG. 14 is a sectional view of the air intake duct shown in FIG. 13.

The present embodiment is not limited to the example in which the protrusions 71, 72 are formed along the longitudinal direction as described above. FIG. 13 is a perspective view of an air intake duct 70B according to a second modification of the fourth embodiment, and FIG. 14 is a sectional view taken along the longitudinal direction. As shown in FIGS. 13 and 14, a pair of protrusions 81, 82 for applying a tension to the cover member 32 may be provided on the holding member 52 such that they extend in the circumferential direction and interpose the opening portions 36 therebetween, and circumferential grooves 83, 84 for receiving the protrusions 81, 82 may be formed in the duct body 12. Also with this structure, tension can be applied to the cover member 32 as shown by an arrow is in FIG. 14. Here, in FIG. 13, for easy explanation, the illustration of the cover member 32 is omitted. In the examples shown in FIGS. 12 to 14, the protrusions 71, 72 are provided on the holding member 52 and the groove portions 73, 74 are formed in the duct body 12. However, the protrusions 71, 72 may be provided on the duct body 12 and the groove portions 73, 74 may be formed in the holding member 52.

<Fifth Embodiment

Figure 15:
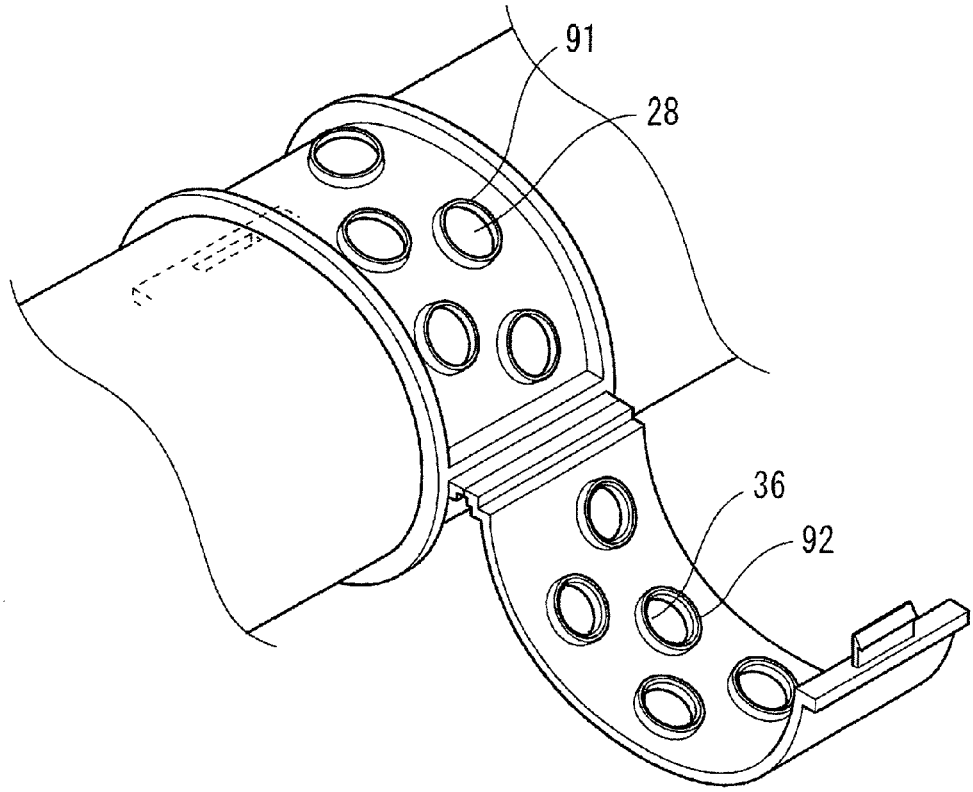
FIG. 15 is a perspective view of an air intake duct according to a fifth embodiment of the present invention.

In the fourth embodiment, the tension is applied to the entire cover member 32. However, as long as the tension is applied to at least areas on the cover member 32 that correspond to the vent holes 28, the above noise reduction effect can be expected. FIG. 15 is a perspective view of an air intake duct 90 according to a fifth embodiment of the present invention, and FIG. 16 is an enlarged sectional view taken along the plane perpendicular to the longitudinal direction.

Figure 16:
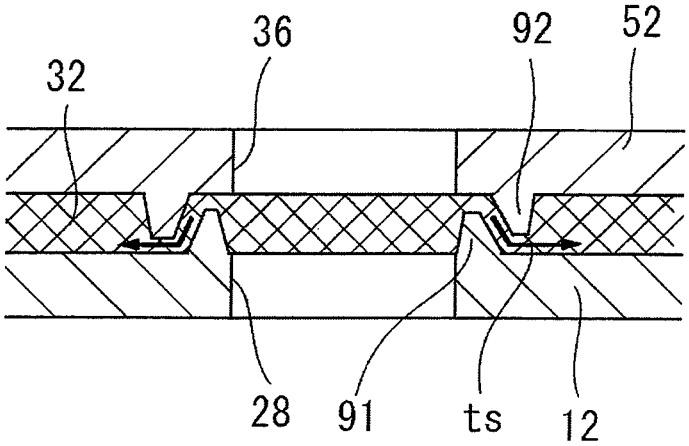
FIG. 16 is an enlarged sectional view of a main portion of the air intake duct shown in FIG. 15.

As shown in FIGS. 15 and 16, according to the air intake duct 90 of the fifth embodiment, a ring-shaped protrusion (a holding receiving portion) 91 is formed along the outer circumferential edge of the vent hole 28 of the duct body 12, and a corresponding ring-shaped protrusion (a holding portion) 92 is formed along the outer circumferential edge of the opening portion 36. Also with this structure, the cover member 32 can be held on the duct body 12 by the holding member 52 with tension being applied to the cover member 32.

Here, when forming the protrusions 91, 92 on the outer circumferential edges of the vent hole 28 and opening portion 36 in this manner, it is preferable to employ the structure shown in FIG. 16, so that tension can reliably be applied to the cover member 32. In FIG. 16, when the holding member 52 is secured to the duct body 12, the radially outer side wall of the protrusion 91 presses the radially inner side wall of the protrusion 92 via the cover member 32.

Figure 17:
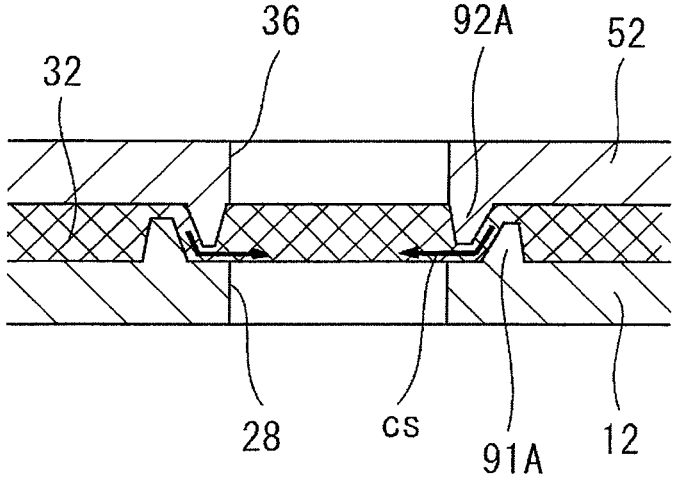
FIG. 17 is an enlarged sectional view of a main portion of an air intake duct according to a reference example.

On the other hand, as shown in a reference example of FIG. 17, in a case in which the radially inner side wall of a protrusion 91A presses the radially outer side wall of a protrusion 92A, a stress cs is applied to the cover member 32 such that it compresses the cover member 32 toward the vent hole 28. That is, when securing the holding member 52 to the duct body 12, the inner side wall of the protrusion 91A and the outer side wall of the protrusion 92A act to move the cover member 32 from outside to inside with respect to the vent holes 28. Therefore, a compression stress is applied to the areas on the cover member 32 that correspond to the vent holes 28, so that tension is less likely to be applied to the areas on the cover member 32 that correspond to the vent holes 28.

In contrast, according to the structure shown in FIG. 16, as the holding member 52 presses the cover member 32 against the duct body 12, the cover member 32 that has been in contact with the outer side wall of the protrusion 91 is pressed toward the outside of the vent holes 28 by the inner side wall of the protrusion 92. Therefore, the tension is can be applied to the areas on the cover member 32 that correspond to the vent holes 28.

<Sixth Embodiment

In the first to fifth embodiments, description has been given of the examples where the holding member 34, 52 is provided on the outer circumferential surface of the duct body 12. However, as shown in the sectional view of an air intake duct of FIG. 18, a holding member 52A may be provided on the inner circumferential surface of the duct body 12.

Figure 18:
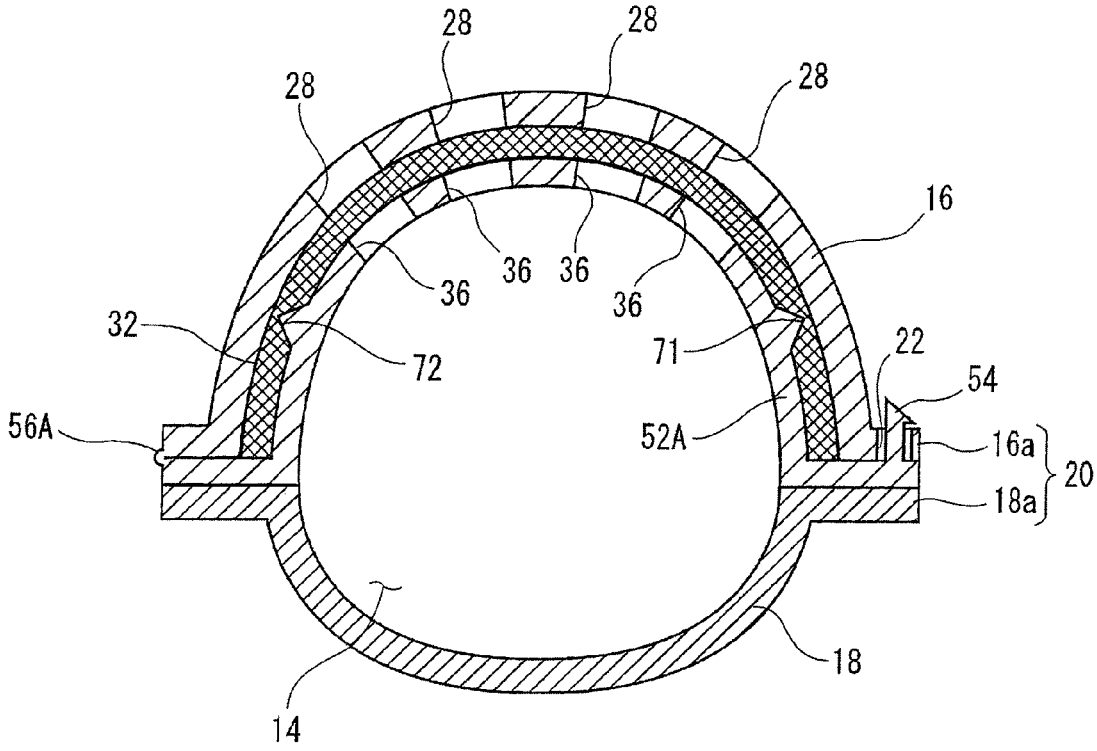
FIG. 18 is a sectional view of an air intake duct according to a sixth embodiment of the present invention.

FIG. 18 is a sectional view of the duct body 12 of an air intake duct according to a sixth embodiment of the present invention. The holding member 52A is rotatably attached to the first half body 16 of the duct body 12 via a hinge portion 56A. The pawl portion 54 is provided on a side opposite to the hinge portion 56A in the circumferential direction. When the pawl portion 54 is engaged with the pawl hole 22 of the flange 20, the holding member 52A is held by the first half body 16. The first half body 16 and the second half body 18 are joined together at a position shifted along the longitudinal direction of the duct body 12 from the section shown in FIG. 18 with the flange portions 16*a*, 18*a* butted against each other, by means of a vibration welding, bonding using an adhesive, or a mechanical fastening using such as a rivet or a bolt.

In this embodiment, the holding member 52A extends along the inner circumferential surface of the duct body 12, and the protrusions 71, 72 provided on the outer circumferential surface of the holding member 52A press the cover member 32 against the first half body 16, whereby the cover member 32 is secured to the duct body 12. The holding member 52A holds a portion of the cover member 32 at a location different from the vent holes 28 of the duct body 12.

As described above, also in this embodiment, pressure variations inside the air flow passage 14 can be released outward from the vent holes 28 through the opening portions 36 and the cover member 32, thereby suppressing the pipe resonance inside the air flow passage 14. Also, similarly to the first embodiment, a pair of ribs opposed to each other across the vent holes 28 may be provided on the inner circumferential surface of the duct body 12 such that they extend in the circumferential direction of the duct body 12.

While the present invention has been described with reference to embodiments thereof, the technical scope of the present invention is not limited to the scope of the description of the above embodiments, and it is apparent for those skilled in the art that various changes and modifications can be made in the above embodiments.

For example, while the flow section of the air flow passage 14 is formed in a circular form in the above embodiments, it may have a polygonal shape, such as a quadrangular shape, an elliptic shape or other shapes.

Further, although description has been given with regard to the vent hole 28 having a circular shape, the vent hole 28 may have a polygonal shape, such as a quadrangular shape, an elliptic shape or other shapes. The vent holes 28 of the set of openings 26 may have the same dimension as described above, may have similar figures to each other, may be different in shapes, or may be a combination of thereof.

The sets of openings 26A to 26C disposed at the respective positions spaced from each other in the longitudinal direction of the duct body 12, the total opening length of the vent holes 28 of each of the sets in circumferential direction may be designed to become smaller as it approach the inlet port. That is, the total opening length of the second set of openings 26B located nearer to the inlet port than the first set of openings 26A may be smaller than the total opening length of the first set of openings 26A, and the total opening length of the third set of openings 26C located nearer to the inlet port than the second set of openings 26B may be smaller than the total opening length of the second set of openings 26B. According to this configuration, the pipe resonance can be suitably suppressed while minimizing the number and size of the vent holes 28 formed in the duct body 12.

The above description has been given with regard to examples having the two flanges 20 that are spaced from each other in the circumferential direction. However, the number of flanges 20 may be one, or three or more. Further, while the attaching structure for the holding member is configured such that the pawl portion engages with a pawl hole, it may be configured such that the pawl portion is formed in the duct body and the pawl hole is opened in the holding member, or may have other structures.

Further, in the above description, the pair of protrusions (the holding portion and the holding receiving portion) 71, 72, 91, 92 formed on the duct body 12 and the holding member 34, 52 respectively are ring-shaped protrusions. However, the present invention is not limited to these examples. For example, they may be in a form of a frame having a polygonal shape, such as a triangular or quadrangular shape, surrounding the vent hole 28 or the opening portion 36, or may be a plurality of intermittent protrusions formed along the outer peripheries of the vent holes 28 and the opening portions 36.

The present application is based on Japanese Patent Application No. 2010-131358 filed on Jun. 8, 2010, and the content of which is incorporated herein by reference.

According to the present invention, there is provided an air intake duct in which a cover member can easily be attached to a duct body while ensuring ventilation, by using a holding member that holds a portion at a location different from a vent hole of the duct body.

The invention claimed is:

1. An air intake duct comprising:

a duct body comprising an air flow passage communicating from one end to another end of the duct body and a vent hole communicating from the air flow passage to an outside of the duct body;

an air permeable cover member arranged to cover the vent hole; and a holding member extending along an outer circumferential surface or an inner circumferential surface of the duct body to secure the cover member to the duct body, wherein the holding member holds a portion of the cover member at a location different from the vent hole of the duct body, wherein an opening portion is provided in the holding member at a location corresponding to the vent hole of the duct body, wherein the holding member comprises a pair of holding portions opposed to each other across the opening portion, wherein the pair of holding portions presses the cover member against the duct body such that a tension is applied to the cover member, wherein the duct body is formed with a pair of holding receiving portions at locations corresponding to the pair of holding portions, and wherein, with regard to each of the holding portions and a corresponding one of the holding receiving portions, one of the holding portion and the holding receiving portion protrudes toward the other of the holding portion and the holding receiving portion such that the one of the holding portion and the holding receiving portion is inserted into the other of the holding portion and the holding receiving portion to hold the cover member between the holding portion and the holding receiving portion.

2. The air intake duct according to claim 1, wherein at least one end portion of the holding member is detachably attached to the duct body.

3. The air intake duct according to claim 1, wherein the outer circumferential surface or the inner circumferential surface of the duct body is formed with a pair of ribs opposed to each other across the vent hole and extending in a circumferential direction of the duct body, and wherein both the holding member and the cover member are fitted between the pair of ribs.

4. The air intake duct according to claim 1, wherein the holding member extends in a circumferential direction of the air flow passage of the duct body, wherein a locking portion is provided on at least one end of the holding member in the circumferential direction, and wherein a lock receiving portion to which the locking portion is secured is provided on the duct body.

5. The air intake duct according to claim 4, wherein a hinge portion is provided on another end of the holding member in the circumferential direction, wherein the holding member is rotatable with respect to the duct body around the hinge portion serving as a rotation center, and wherein the hinge portion is formed as a one-piece structure together with the duct body and the holding member.

6. The air intake duct according to claim 5, wherein the holding portions are protrusions protruding from the holding member toward the duct body and extending in a longitudinal direction of the duct body, wherein one of the holding portions is provided near the hinge portion and the other holding portion is provided near the locking portion, and wherein said one of the holding portions provided near the hinge portion has a higher protruding height than the other holding portion provided near the locking portion.

7. The air intake duct according to claim 1, wherein an end of the holding member in a circumferential direction is rotatably mounted on the duct body, and wherein, when the holding member rotates, one of the holding portions that is near a rotation center of the holding member holds the cover member earlier than the other holding portion that is far from the rotation center.

8. The air intake duct according to claim 7, wherein the holding portions are protrusions protruding from the holding member toward the duct body, and wherein said one of the holding portions that is near the rotation center of the holding member has a higher protruding height than the other holding portion that is far from the rotation center of the holding member.

9. The air intake duct according to claim 1, wherein the holding portions and the holding receiving portions extend in a circumferential direction of the duct body.

10. The air intake duct according to claim 1, wherein the duct body is cylindrical, the holding member is U-shaped, and the cover member is U-shaped.

11. An air intake duct comprising:

a duct body comprising an air flow passage communicating from one end to another end of the duct body and a vent hole communicating from the air flow passage to an outside of the duct body;

an air permeable cover member arranged to cover the vent hole; and a holding member extending along an outer circumferential surface or an inner circumferential surface of the duct body to secure the cover member to the duct body, wherein the holding member holds a portion of the cover member at a location different from the vent hole of the duct body, wherein an opening portion is provided in the holding member at a location corresponding to the vent hole of the duct body, wherein a first ring-shaped protrusion is provided on an outer periphery of the opening portion of the holding member, wherein a second ring-shaped protrusion corresponding to the first ring shaped protrusion is provided on an outer periphery of the vent hole of the duct body, wherein the first ring-shaped protrusion is arranged to surround the second ring-shaped protrusion, and wherein the first ring-shaped protrusion and the second ring-shaped protrusion hold the cover member between a radially inner side wall of the first ring-shaped protrusion and a radially outer side wall of the second ring-shaped protrusion and apply a tension to the cover member.

12. The air intake duct according to claim 11, wherein, when the holding member secures the cover member to the duct body, the radially outer side wall of second ring-shaped protrusion is pressed by the radially inner side wall of the first ring-shaped protrusion via the cover member.

13. The air intake duct according to claim 11, wherein the duct body is cylindrical, the holding member is U-shaped, and the cover member is U-shaped.

* * * * *